US010319276B2

(12) United States Patent
Han et al.

(10) Patent No.: US 10,319,276 B2
(45) Date of Patent: Jun. 11, 2019

(54) DISPLAY APPARATUS AND CALIBRATION METHOD THEREOF

(71) Applicant: SAMSUNG ELECTRONICS CO., LTD., Suwon-si, Gyeonggi-do (KR)

(72) Inventors: Seung-ryong Han, Yongin-si (KR); Byung-chul Kim, Suwon-si (KR); Jin-sung Lee, Suwon-si (KR); Ho-young Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 101 days.

(21) Appl. No.: 15/484,381

(22) Filed: Apr. 11, 2017

(65) Prior Publication Data

US 2018/0114475 A1 Apr. 26, 2018

(30) Foreign Application Priority Data

Oct. 24, 2016 (KR) ..... 10-2016-0138260

(51) Int. Cl.
*G09G 3/20* (2006.01)
*G09G 3/32* (2016.01)

(52) U.S. Cl.
CPC ..... *G09G 3/2003* (2013.01); *G09G 3/2092* (2013.01); *G09G 3/32* (2013.01); *G09G 2320/0242* (2013.01); *G09G 2320/0666* (2013.01); *G09G 2320/0693* (2013.01); *G09G 2340/06* (2013.01)

(58) Field of Classification Search
CPC ..... G09G 3/2003; G09G 3/2092; G09G 2320/0686; G09G 2320/0693; G09G 5/02; G09G 5/10; H04N 9/64
See application file for complete search history.

(56) References Cited

U.S. PATENT DOCUMENTS 7,907,154 B2 3/2011 Rykowski et al.
9,653,041 B2 * 5/2017 Nakanishi ..... G09G 3/2003
2006/0012724 A1 1/2006 Park
(Continued)

FOREIGN PATENT DOCUMENTS

JP 2012-150269 8/2012
JP 2012-242420 12/2012
(Continued)

OTHER PUBLICATIONS

The Color Guide and Glossary, *Communication, measurement, and control for Digital Imaging and Graphic Arts*, 2004, 52 pages.
(Continued)

*Primary Examiner* — Sardis F Azongha
(74) *Attorney, Agent, or Firm* — Nixon & Vanderhye P.C.

(57) ABSTRACT

A display apparatus is provided. The display apparatus includes a display panel comprising a plurality of pixels, a panel driver configured to drive the display panel, a storage configured to store information regarding a color gamut of each of the plurality of pixels, and a processor configured to determine a target color gamut of each of the plurality of pixels so that a difference in color gamut from at least one adjacent pixel is equal to or less than a predetermined threshold value, and to drive the panel driver for each of the plurality of pixels to have a grayscale value based on the target color gamut.

9 Claims, 4 Drawing Sheets

(56) References Cited

U.S. PATENT DOCUMENTS

| | | | | |
|---|---|---|---|---|
| 2007/0127836 | A1* | 6/2007 | Subbotin | G06T 5/20 382/260 |
| 2007/0285530 | A1 | 12/2007 | Kim et al. | |
| 2013/0191056 | A1 | 6/2013 | Gern et al. | |
| 2013/0293599 | A1 | 11/2013 | Wakisaka et al. | |
| 2015/0103094 | A1* | 4/2015 | Xue | H04N 1/6072 345/596 |

FOREIGN PATENT DOCUMENTS

| | | |
|---|---|---|
| KR | 10-2003-0097507 | 12/2003 |
| KR | 10-2007-0113890 | 11/2007 |

OTHER PUBLICATIONS

D. MacAdam, "Visual Sensitivities to Color Differences in Daylight", *Journal of the Optical Society of America*, vol. 42, No. 5, May 1942, 28 pages.

M. Habekost, "Which color differencing equation should be used", *International Circular of Graphic Education and Research*, No. 6, 2013, 7 pages.

* cited by examiner

DISPLAY APPARATUS AND CALIBRATION METHOD THEREOF

CROSS-REFERENCE TO RELATED APPLICATION

This application is based on and claims priority under 35 U.S.C. § 119 to Korean Patent Application No. 10-2016-0138260, filed on Oct. 24, 2016 in the Korean Intellectual Property Office, the disclosure of which is incorporated by reference herein in its entirety.

BACKGROUND

1. Field

The present disclosure relates generally to a display apparatus and a calibration method thereof, and for example, to a display apparatus capable of adjusting a color gamut of a pixel and a calibration method thereof.

2. Description of Related Art

Light Emitting Diode (LED) is a semiconductor light emitting element that converts current into light and recently, the LED has been widely used as light source for display, a light source for automobile, and a light source for illumination.

However, the range of colors that can be expressed by the LEDs may be different from each other due to problems in the manufacturing process, and when the LED is used as a display panel, there is a problem that the same color (or color sense) cannot be provided to a user. In order to solve this problem, when the color gamut of all the LEDs is adjusted to be the same, the color gamut becomes narrow and the color reproducibility becomes poor.

Accordingly, there is a demand for finding a way to improve color reproducibility while providing the same color (or color sense) to the user.

SUMMARY

An aspect of the example embodiments relates to a display apparatus which determines a target pixel for each pixel for a difference between gamuts to be equal to or less than a predetermined threshold value and a calibration method thereof.

According to an example embodiment, a display apparatus is provided, including a display panel configured to include a plurality of pixels, a panel driver configured to drive the display panel, a storage configured to store information regarding a color gamut of each of the plurality of pixels, and a processor configured to determine a target color gamut of each of the plurality of pixels for a difference in color gamut from at least one adjacent pixel to be equal to or less than a predetermined threshold value, and to drive the panel driver for each of the plurality of pixels to have a predetermined grayscale value, wherein the predetermined grayscale value is determined based on the target color gamut.

The predetermined threshold value may be determined based on a Just Noticeable Difference (JND) of a color gamut difference with the at least one adjacent pixel.

The processor may determine a target color gamut of the pixels for each of a color gamut difference between a pixel and at least one first adjacent pixel and a color gamut difference between the first adjacent pixel and at least one second adjacent pixel to be equal to or less than the predetermined threshold value.

The processor may determine a color coordinate of the pixels for a color coordinate difference between a color coordinate corresponding to a maximum grayscale value of a pixel and a color coordinate corresponding to a maximum grayscale value of at least one adjacent pixel to be equal to or less than the predetermined threshold value.

The processor may determine a color coordinate of the pixels for a difference in Lab color coordinate between a maximum grayscale value of a pixel and a maximum grayscale value of at least one adjacent pixel to be equal to or less than the predetermined threshold value.

According to an example embodiment, a calibration method is provided, including calculating (determining) a color gamut difference from at least one adjacent pixel based on information of a color gamut of each of a plurality of pixels and determining a target color gamut of each of the plurality of pixels for the determined color gamut difference to be equal to or less than a predetermined threshold value.

The predetermined threshold value may be determined based on a Just Noticeable Difference (JND) of a color gamut difference with the at least one adjacent pixel.

The determining may include setting a target color gamut of the pixels for each of a color gamut difference between a pixel and at least one first adjacent pixel and a color gamut difference between the first adjacent pixel and at least one second adjacent pixel to be equal to or less than the predetermined threshold value.

The setting may include setting a color coordinate of the pixels for a color coordinate difference between a color coordinate corresponding to a maximum grayscale value of a pixel and a color coordinate corresponding to a maximum grayscale value of at least one adjacent pixel to be equal to or less than the predetermined threshold value.

The setting may include setting a color coordinate of the pixels for a difference in Lab color coordinate between a maximum grayscale value of a pixel and a maximum grayscale value of at least one adjacent pixel to be equal to or less than the predetermined threshold value.

According to the various example embodiments, a color gamut of LED pixels are adjusted by setting a target color gamut of each LED pixel separately based on a color gamut recognized as the same color (or color sense) by a user and thus, the color gamut can be expanded and color reproducibility can be improved as compared with a case in which a common color gamut is used for each pixel while providing the same color (or color sense) to the user.

BRIEF DESCRIPTION OF THE DRAWINGS

The above and/or other aspects, features and attendant advantages of the present disclosure will be more apparent and readily appreciated from the following detailed description, taken in conjunction with the accompanying drawings, in which like reference numerals refer to like elements, and wherein.

DETAILED DESCRIPTION

Hereinafter, various example embodiments will be described in greater detail with reference to the accompanying drawings.

Figure 1:
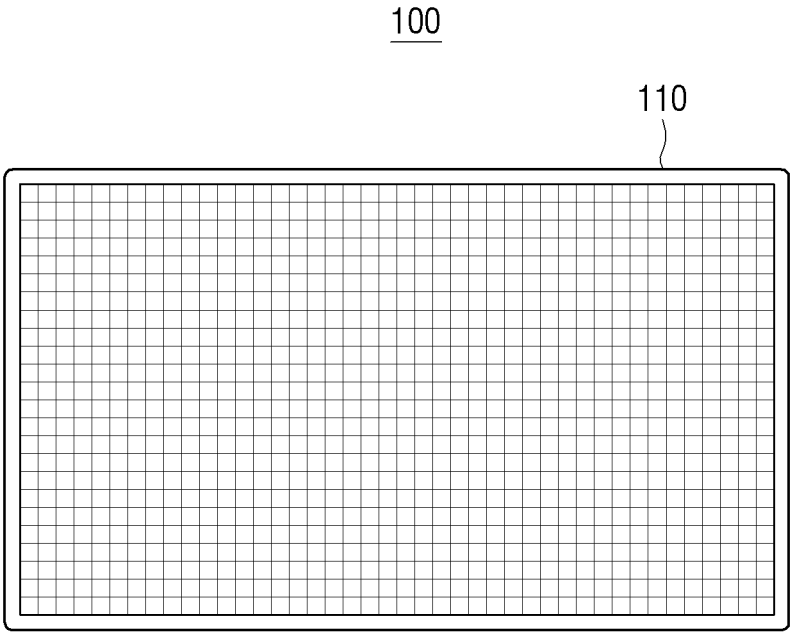
FIG. 1 is a diagram illustrating an example configuration of a display apparatus according to an example embodiment.

FIG. 1 is a diagram illustrating an example configuration of a display apparatus according to an example embodiment.

Referring to FIG. 1, a display apparatus 100 according to an example embodiment includes a display panel 110.

The display panel 110 may include a plurality of pixels which are arranged in matrix form. In this case, each pixel may be implemented as an LED pixel (for example, an LED element) and for example, the LED pixel may be implemented as a RGB LED to include sub pixels, RED LED, GREEN LED and BLUE LED.

Meanwhile, the display panel 110 may be implemented, for example, and without limitation, as a display module including a plurality of LED pixels, an LED cabinet in which a plurality of display modules including at least one LED pixel, respectively, are connected, or the like.

In the case of LED pixels, a color gamut of each pixel may be different from each other due to a manufacturing process. Accordingly, even if different LED pixels display data of the same grayscale, the color (or color sense) represented by each LED pixel may be different from each other. In order to address the above problem, an image can be represented using a color gamut that can represent all LED pixels but in this case, the color gamut of the display apparatus 100 may be excessively reduced and thus, color reproducibility may be substantially deteriorated.

Therefore, according to an example embodiment, a color gamut of LED pixels are adjusted based on a color gamut recognized by a user as the same color (or color sense) by setting a target color gamut of each LED pixel separately. Accordingly, a color gamut can be expanded and color reproducibility can be improved as compared with a case in which a common color gamut is used for each LED pixel. Various example embodiments regarding this feature will be described herein in greater detail.

Figure 2:
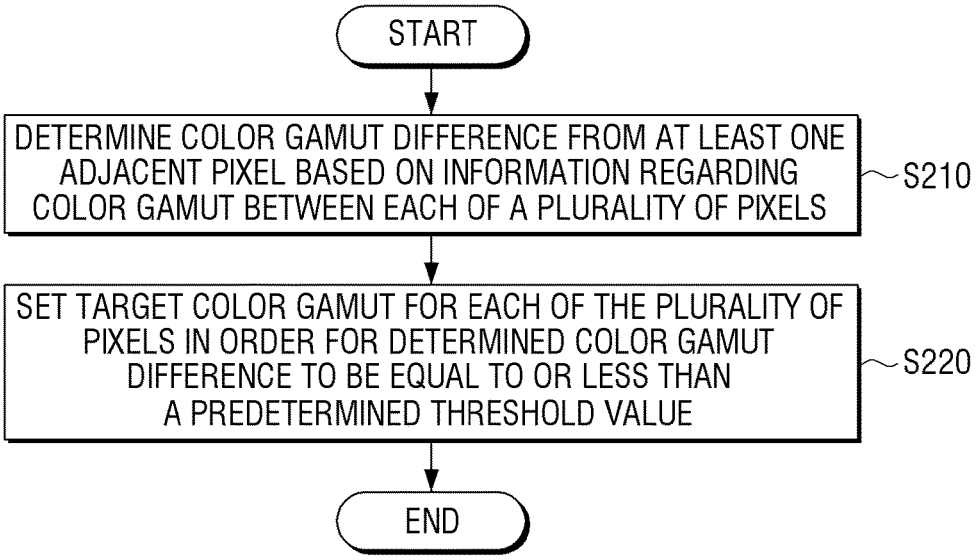
FIG. 2 is a flowchart illustrating an example calibration method according to an example embodiment.

FIG. 2 is a flowchart illustrating an example calibration method according to an example embodiment.

A color coordinate difference from at least one adjacent pixel is calculated (determined) based on color coordinate information regarding each of a plurality of pixels (S210).

To do so, light emitted from each pixel is photographed using a spectrometer to obtain a spectrum for each pixel.

In this case, the spectrum may be represented by the wavelength of the light emitted from the pixel and the intensity at the wavelength.

Subsequently, R, G, B spectrum may be obtained by analyzing the wavelength of Red (R), Green (G) and Blue (B) colors of the spectrum and a color gamut of each pixel may be obtained by processing the obtained spectrum according to a Commission Internationale de l'Eclairage (CIE) color system.

As such, information regarding a color gamut of pixels may be obtained using a spectrometer. Accordingly, in the case in which data with a specific grayscale value is displayed through each sub pixel composing pixels, color coordinate information regarding the light emitted from the corresponding pixel and a grayscale value corresponding to the color coordinate information may be obtained.

However, this is only an example, and the information regarding a color gamut of pixels may be obtained in various ways.

Subsequently, a color gamut difference from at least one adjacent pixel is determined. In other words, a color gamut difference between a pixel and at least one adjacent pixel is calculated.

To do so, the xy values of the CIE color coordinates for the pixel and at least one adjacent pixel are converted into XYZ values, and a color gamut of the corresponding pixels may be represented in the CIELAB color space using the XYZ values.

The color gamut difference between the corresponding pixels may be determined through the difference between L*, a* and b* values of the pixel and those of at least one adjacent pixel in the CIELAB color space. However, the color space is not limited to L*, a* and b* spaces, and a color gamut difference may be calculated in various spaces, not only the CIELAB space but also a u'v' space, a CIE2001 space, or the like.

If data having a specific grayscale value for each sub pixel of the pixels is displayed, the color gamut difference between the pixels may be determined based on the difference between the color coordinates indicated by the pixels and the color coordinates indicated by adjacent pixels.

For example, it is assumed that a color signal regarding RGB includes 256 steps of grayscale.

In this case, if the data having the grayscale values of (255, 0, 0), (0, 255, 0), and (0, 0, 255) which are the maximum grayscale for each of the R, G, B sub pixels of the pixels, (e.g., if driving each of the RED LED, the GREEN LED, and the BLUE RED using a driving signal having a duty ratio of 100%), and the data having the color coordinates indicated by the pixels and grayscale values of (255, 0, 0), (0, 255, 0), and (0, 0, 255) which are the maximum grayscale for each of the R, G, B sub pixels of adjacent pixels is displayed, the color gamut difference between the corresponding pixels and the adjacent pixels may be calculated based on the difference in color coordinates indicated by the adjacent pixels.

The color gamut difference between the pixel and at least one adjacent pixel may be summed.

Figure 3:
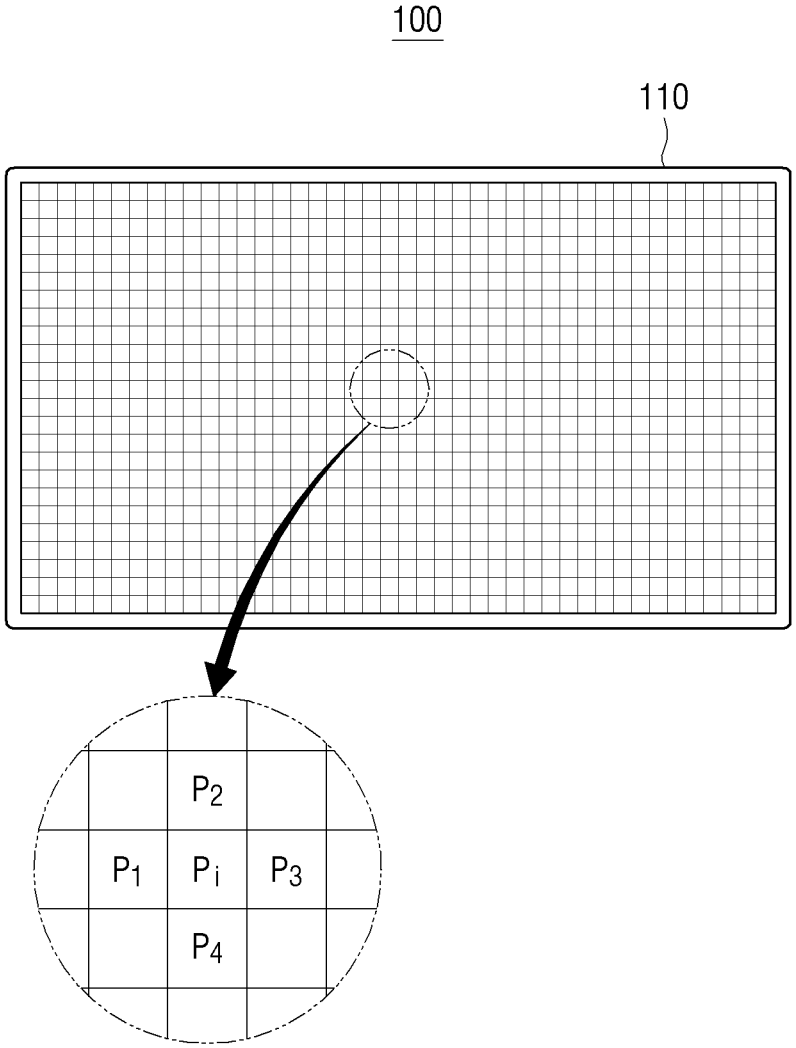
FIG. 3 is a diagram illustrating an example calibration method according to an example embodiment.

For example, with reference to FIG. 3, when data having the maximum grayscale value is displayed, the color coordinates L*, a* and b* of the pixel Pi are assumed to be L*i, a*i and b*i.

In this case, a value $\Delta E_{ab}{}^{i}$ obtained by adding the color gamut difference between the pixel Pi and the four adjacent pixels $P_1$, $P_2$, $P_3$ and $P_4$ located on the upper side, the lower side, the left side, and the right side of the pixel Pi can be determined based on the following equation.

[Mathematical Equation 1]

$$\Delta E_{ab}^{i} = \sum_{n=1}^{4} (p_i - p_n)$$

Here, pi-pn corresponds to $\sqrt{(L_i^* - L_n^*)^2 + (a_i^* - a_n^*)^2 + (b_i - b_n^*)^2}$.

Meanwhile, in the above example, when determined the color gamut difference between pixels, the color gamut difference between the pixel and the four pixels located on the upper side, lower side, left side, and right side of the pixel is determined. However, this is only an example, and the location and the number of adjacent pixels used for determination of the color gamut difference value may be determined in various ways. For example, the color gamut difference between the pixel and the eight pixels located on the upper side, upper right side, right side, lower right side, lower side, lower left side, left side, and upper left side of the pixel may be determined.

In addition, in the above example, when determining the color gamut difference between pixels, the color gamut difference between the pixel and the immediately adjacent pixel is determined. However, this is only an example, and it is possible to determine the color coordinate difference between a pixel and a pixel located within a predetermined distance from the pixel even if it is not immediately adjacent to the pixel. For example, the color gamut difference between the pixel and the four pixels located on the upper, lower, left and right sides of the pixel and the four pixels located on the upper, lower, left, and right sides of the four pixels, that is, the color gamut difference between the pixels and the eight pixels may be determined.

In addition, in the above example, when determining the color gamut difference, the difference between the color coordinate corresponding to the maximum grayscale value of a pixel and the color coordinate corresponding to the maximum grayscale value of an adjacent pixel is determined. However, this is only an example, and it is also possible to determine the color gamut difference between the pixel and its adjacent pixels through the difference between the color coordinates corresponding to at least one of the gray-scale values, or through the difference in color coordinates between uncommon portions of color gamut of each of the pixel and its adjacent pixels.

Meanwhile, once the color gamut difference is determined, it is possible to determine a target color gamut in order for each of the plurality of pixels for the determined color gamut different to be equal to or less than a predetermined threshold value (S220).

For example, the target color gamut may be determined for each of the plurality of pixels in order for the color gamut difference between a pixel and at least one adjacent pixel to be equal to or less than a predetermined threshold value, and for a value obtained by adding up the color gamut difference between the pixel and at least one adjacent pixel to be equal to or less than a predetermined threshold value.

In this case, the target color gamut for each of the plurality of pixels may be the same as the color gamut of each pixel itself or may be different from the color gamut of each pixel itself. For example, if the intrinsic color gamut of a specific pixel is narrower than the target color gamut of the remaining pixels, the color gamut of the specific pixel itself may be determined as the target color gamut of the corresponding pixel.

Meanwhile, the predetermined threshold value (th) may be set based on the JND regarding the color gamut from at least one adjacent pixel.

Here, the JND may refer, for example, to the minimum difference in the color space recognized by the human eye.

Specifically, in the CIELAB color space, $\Delta E_{ab}^*$ is a measure used to represent the color difference, and when $\Delta E_{ab}^*$ is less than 2.3 (=JND value), a person recognizes two colors as the same color. In this case, if the two colors represented by L*, a* and b* are (L*1, a*1, b*1) and (L*2, a*2, b*2), $\Delta E_{ab}^* = \sqrt{(L_2^* - L_1^*)^2 + (a_2^* - a_1^*)^2 + (b_2 - b_1^*)^2}$.

Accordingly, in the example embodiment, the threshold value may be determined based on the number of adjacent pixels considered for determining the target color gamut of one pixel.

For example, it may be assumed that four adjacent pixels are considered for determining the target color gamut of one pixel.

In this case, since the number of adjacent pixels is four, the threshold value may be 4×2.3 when the color gamut differences between the pixel and four adjacent pixels are all summed. However, the threshold value regarding the color gamut differences between the pixel and each of the adjacent pixels may be 2 or 3.

Meanwhile, in the above example, the threshold value is determined based on the JND, but this is only an example. The threshold value may be determined in various ways based on a color tolerance model.

For example, in the CIE 1931 color space, there is a minimum geometric distance needed to recognize the color difference between two points. In other words, as defined by MacAdam ellipse, in the CIE 1931 color space, the color within a certain size area is perceived as the same color in the human eye. Accordingly, the threshold value according to an example embodiment may be determined according to a color tolerance model generated based on MacAdam ellipse.

Meanwhile, the method of setting a target color gamut for each of the plurality of pixels is as below.

First, it is determined whether the equations 2 and 3 are satisfied for each pixel.

$$\sum_{j \in Nei(p_i)}^{N} p_i - p_j \le N \times th \qquad \text{[Mathematical Equation 2]}$$

Here, Nei (pi) represents the adjacent pixel of the pixel pi, and N represents the number of the adjacent pixels adjacent to the pixel Pi. In addition, th represents the threshold value and may be 2 or 3.

$$p_i - p_j \le th \qquad \text{[Mathematical Equation 3]}$$

Here, pj represents the pixels adjacent to Pi. In addition, th represents the threshold value and may be 2 or 3.

Specifically, through the equation 2, for each pixel, it is determined whether the color gamut difference between a pixel and its adjacent pixels is equal to or less than a predetermined threshold value, and through the equation 3, for each pixel, it is determined whether the color gamut difference between a pixel and its adjacent pixels is equal to or less than a predetermined threshold value.

For example, referring to FIG. 3, in the case of the pixel pi, the adjacent pixels are pixels p1, p2, p3, and p4.

Accordingly, for the pixel pi, it is determined whether the equation 2 is satisfied, that is, whether (pi−p1)+(pi−p2)+(pi−p3)+(pi−p4)≤4×2.3 is satisfied, and whether the equation 3 is satisfied, that is whether (pi−p1)≤2.3, (pi−p2)≤2.3, (pi−p3)≤2.3, (pi−p4)≤2.3 is satisfied. Here, pi−pn(n=2,4,6, 8) corresponds to $\sqrt{(L_1^* - L_n^*)^2 + (a_1^* - a_n^*)^2 + (b_1 - b_n^*)^2}$.

According to the above method, it is possible to determine whether the equations 2 and 3 are satisfied for each of the plurality of pixels included in the display panel 110.

If the equations 2 and 3 are satisfied for all pixels, the color gamut of each pixel may be determined as a target color gamut.

In other words, for each pixel, if the color gamut difference between a pixel and at least one adjacent pixel is equal to or less than a predetermined threshold value, and a value obtained by adding up the color gamut difference between the pixel and at least one adjacent pixel is equal to or less than a predetermined threshold value, an intrinsic color gamut of the pixel may be determined as the target color gamut.

However, if at least one of the equations 2 and 3 is not satisfied for at least one pixel, the color gamut of the at least one pixel from among the plurality of pixels may be adjusted and the target color gamut of each of the plurality of pixels may be determined.

In other words, for each pixel, if the color gamut difference between a pixel and at least one adjacent pixel is greater than a predetermined threshold value, a value obtained by adding up the color gamut difference between the pixel and at least one adjacent pixel is greater than a predetermined threshold value, or both of the values are greater than a predetermined threshold value, a target color gamut for each of the plurality of values may be determined by adjusting the color gamut for at least one of the plurality of pixels.

For example, the target color gamut for the pixels may be determined in order for the color gamut difference value between the pixel and the at least one first adjacent pixel and the color gamut difference value between the first adjacent pixel and the at least one second adjacent pixel adjacent to the first adjacent pixel to be respectively equal to or less than a predetermined threshold value.

In this case, the color coordinates of the pixel may be determined in order for the difference between the color coordinates corresponding to the maximum grayscale value of the pixel and the color coordinates corresponding to the maximum grayscale value of at least one adjacent pixel to be equal to or less than a predetermined threshold value.

Here, the color coordinates of the pixel may be set in order for so that the difference between the Lab color coordinate value corresponding to the maximum grayscale value of the pixel and the Lab color coordinate value corresponding to the maximum grayscale value of least one adjacent pixel to be equal to or less than a preset threshold value.

In other words, the target color gamut for each of the pixel, the first adjacent pixel and the second adjacent pixel may be determined by adjusting the color coordinates of the pixel, the first adjacent pixel and the second adjacent pixel in order for the color gamut difference value between the pixel and at least one first adjacent pixel and the first adjacent pixel and at least one second adjacent pixel which is adjacent to the first adjacent pixel to be respectively equal to or less than a predetermined threshold value.

In this case, at least one of the color coordinates corresponding to the maximum grayscale value of each of the sub pixels of each pixel, the first adjacent pixel and the second adjacent pixel may be adjusted, and the color gamut defined by the color coordinate corresponding to such an adjusted maximum grayscale value may be determined as the target gamut of each of the pixel, the first adjacent pixel, and the second adjacent pixel. However, in some cases, if the color gamut difference between the pixel, the first adjacent pixel, and the second adjacent pixel becomes equal to or less than a predetermined threshold value as a result of adjusting the color coordinates of the first adjacent pixel and the second adjacent pixel, the color coordinate of the pixel may not be adjusted, and the intrinsic color gamut of the pixel may be determined as the target gamut of the pixel.

In other words, when the difference value of the color gamut calculated based on the color gamut of the pixel itself is equal to or less than a predetermined threshold value, that is, when the L*, a*, and b* values of the intrinsic color gamut originally possessed by the pixel satisfy the equations 2 and 3, the color gamut of the pixel itself may be determined as the target color gamut for each pixel.

However, if at least one of the equations 2 and 3 is not satisfied with respect to at least one pixel, the color gamut of at least one pixel is adjusted so as to satisfy both the equations 2 and 3 and the adjusted color gamut may be determined as the target color gamut for each pixel.

For example, for pixel pi, if the equation 2 is not satisfied, the color gamut of the reference pixel pi in the equation 2 may be reduced so as to satisfy the equation 2, and as the color gamut of the pixel pi is changed, the color coordinates L*, a* and b* of the remaining pixels may be appropriately adjusted so as to satisfy the equation 3 for the pixel Pi and to satisfy the equations 2 and 3 for the remaining pixels, and the color gamut defined by the adjusted color coordinates may be determined as the target color gamut of each pixel.

In this case, since the color gamut of a pixel indicates the range of colors that can be represented by the pixel, the color gamut cannot be adjusted in a way that the pixel is wider than the original color gamut of the pixel. Accordingly, the color gamut of each pixel can be determined so as to satisfy all of the equations 2 and 3 while reducing the color gamut of the pixel itself, and the determined color gamut of the each pixel can be the target color gamut of the corresponding pixel.

Meanwhile, in adjusting the color gamut, there may be a case of adjusting the color gamut of all pixels and a case of adjusting the color gamut of only some pixels in order to satisfy both the equations 2 and 3.

In the case of adjusting the color gamut of all pixels, the adjusted color gamut may be determined as the target color gamut of each pixel. Meanwhile, in the case of adjusting the color gamut of only some pixels, the adjusted color gamut may be determined as the target color gamut of the pixel in which the color gamut is adjusted, and the original color gamut may be determined as the target color gamut of the pixel in which the color gamut is not adjusted.

In the above example, the color coordinates corresponding to the maximum grayscale value of the pixel and the adjacent pixel are adjusted in order for the color gamut difference between the pixel and the adjacent pixel to be equal to or less than a predetermined threshold value, and the color gamut defined by the adjusted color coordinate is set as the target color gamut. However, this is only an example, and according to the method of determining the color gamut difference, the color coordinates corresponding to at least one grayscale value of a pixel and adjacent pixels may be adjusted or the color coordinates of a portion not common to the color gamut may be adjusted, and the color gamut defined by the adjusted color coordinates can be determined as the target color gamut.

Meanwhile, in addition to the above-mentioned method, the color gamut of the pixel may be smoothed to set the target color value for the pixel.

Specifically, when the color gamut difference between each pixel is greater than a predetermined threshold value (for example, if either one of the equations 2 and 3 is not satisfied), the color gamut of at least one pixel having a relative broad range from among a plurality of pixels may be smoothed to reduce the gamut of the pixel by a predetermined value.

In this case, the range in which the color gamut is reduced may be determined according to the intensity to which the smoothing is applied.

Based on the reduced color gamut, the color difference value of each pixel is calculated again with respect to each of the plurality of pixels, and it is determined whether the condition that the calculated difference values is equal to or less than a predetermined threshold value is satisfied.

If it is determined that the determined difference values is equal to or less than a predetermined value, the corresponding color gamut may be determined as the target color gamut of each pixel. In other words, in the case of a pixel whose color gamut has been reduced by the smoothing process, the reduced color gamut may be determined as the target gamut of the corresponding pixel, and in the case of a pixel whose color gamut is not smoothed, the intrinsic color gamut of the corresponding pixel may be set as the target gamut of the corresponding pixel.

However, if the determined difference values are greater than a predetermined threshold value, the smoothing process may be performed again.

Specifically, the color gamut of the corresponding pixel is reduced by a predetermined value through the smoothing process regarding the color gamut of at least one pixel having a relatively broader range from among the plurality of pixels, the color gamut difference value between each pixel is calculated again based on the reduced color gamut, and it is determined whether the determined difference values satisfy a predetermined threshold value.

Consequently, the target color gamut for the pixels is determined by performing the smoothing process until the color gamut difference between each pixel becomes equal to or less than a predetermined threshold value.

As described above, according to the various example embodiments, in adjusting the color gamut of pixels, it is not that the color gamut of the pixels are adjusted to have a common color gamut that can be expressed by all of the plurality of pixels but that the color gamut of the pixels are adjusted to have a range recognized by a user as the same color (or color sense). Thus, it is possible not only to provide the same color (or color sense) to the user but also to improve the color reproducibility by expanding the color gamut in comparison with the case in which a color gamut is used.

Figure 4A:
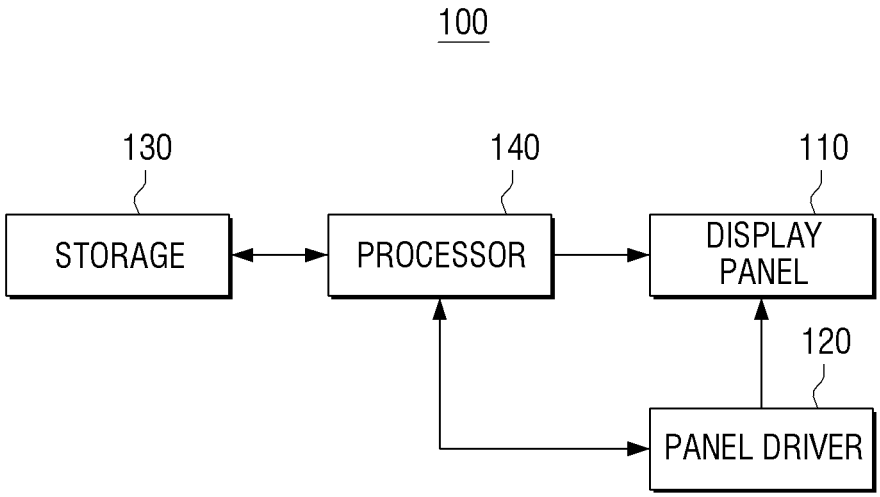
FIGS. 4A and 4B are diagrams illustrating an example configuration of a display apparatus according to an example embodiment.

FIG. 4A is a block diagram illustrating an example configuration of a display apparatus according to an example embodiment.

Referring to FIG. 4A the display apparatus 100 includes the display panel 110, a panel driver 120, a storage 130, and a processor (e.g., including processing circuitry) 140.

The display panel 110 includes a plurality of pixels. In this case, the plurality of pixels may be arranged in a matrix form.

In addition, each pixel may be implemented as an LED pixel and for example, the LED pixel may be implemented as a RGB LED to include sub pixels, RED LED, GREEN LED and BLUE LED.

The panel driver 120 may include various circuitry to drive the display panel 110. For example, the panel driver 120 may apply a driving voltage for driving a plurality of pixels of the display panel 110 under the control of the processor 140 or let a driving current drive the plurality of pixels so that light can be emitted.

The storage 130 stores various data required for an operation of the display apparatus 100.

In particular, the storage 130 stores information regarding a color gamut of each of a plurality of pixels. In this case, the information regarding the color gamut may be obtained through a spectrum of each pixel which is obtained by photographing light emitted from each pixel using a spectrometer.

Figure 4B:
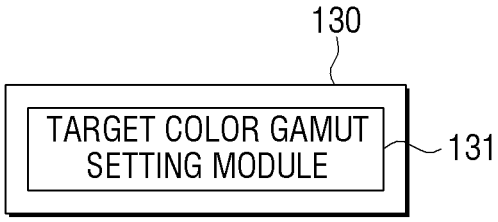

Meanwhile, as illustrated in FIG. 4B, the storage 130 may store an algorithm module for setting a target color gamut, and the processor 140 may set a target color gamut for each pixel using information regarding the color gamut of each pixel through the corresponding module.

To this end, the storage 130 may be implemented in various forms of memory.

The processor 140 may include various processing circuitry that controls the overall operations of the display apparatus 100. To do so, the processor 140 may include, for example, and without limitation, a central processing unit (CPU), Random Access Memory (RAM), Read Only Memory (ROM), etc., and may execute computation or data processing relating to the control of other elements included in the display apparatus 100.

In particular, the processor 140 may set a target color gamut for pixels using information regarding color gamut of the pixels.

In other words, the processor 140 may set a target color gamut for each of a plurality of pixels for a color gamut difference between a pixel and at least one adjacent pixel to be equal to or less than a predetermined threshold value.

To this end, the processor 140 may calculate (determine) a color gamut difference from at least one adjacent pixel. In other words, the processor 140 may calculate a color gamut difference between a pixel and at least one adjacent pixel.

Specifically, the processor 140 may convert the xy values of the CIE color coordinates for the pixel and at least one adjacent pixel into XYZ values, and represent a color gamut of the corresponding pixels in the CIELAB color space using the XYZ values.

The processor 140 may determine the color gamut difference between the corresponding pixels through the difference between L*, a* and b* values of the pixel and those of at least one adjacent pixel in the CIELAB color space.

Here, if data having a specific grayscale value for each sub pixel of each pixel and the adjacent pixels is displayed, the processor 140 may determine the color gamut difference between the pixels based on the difference between the color coordinates indicated by the pixel and the color coordinates indicated by the adjacent pixels.

For example, the processor 140 may determine the difference between the color coordinate corresponding to the maximum gradation value of the pixel and the color coordinate corresponding to the maximum gradation value of the adjacent pixels so as to determine the color gamut difference between the pixel and the adjacent pixels.

However, this is only an example, and it is also possible to determine the color gamut difference between the pixel and its adjacent pixels through the difference between the color coordinates corresponding to at least one of the grayscale values or through the difference in color coordinates between uncommon portions of color gamut of each of the pixel and its the adjacent pixels.

Meanwhile, the predetermined threshold value may be set based on the JND regarding the color gamut difference from at least one adjacent pixel. However, this is only an example, and the predetermined threshold value may be determined in various ways based on a color tolerance model.

After determining the color gamut difference, the processor 140 may set a target color gamut for each of a plurality of pixels for the color gamut difference between a pixel and at least one adjacent pixel to be equal to or less than a predetermined threshold value.

Specifically, the processor 140 may set the target color gamut of the pixels in order for the color gamut difference value between the pixel and the at least one first adjacent pixel and the color gamut difference value between the first adjacent pixel and the at least one second adjacent pixel adjacent to the first adjacent pixel to be respectively equal to or less than a predetermined threshold value.

In other words, the processor 140 may determine the color gamut difference value between the pixel and the at least one first adjacent pixel and the color gamut difference value between the first adjacent pixel and the at least one second adjacent pixel adjacent to the first adjacent pixel, and determine the target color gamut of the pixels in order for each of the determined color gamut differences to be equal to or less than a predetermined threshold value.

In this case, the processor 140 may set the color coordinates of the pixels in order for the difference between the color coordinates corresponding to the maximum grayscale value of the pixel and the color coordinates corresponding to the maximum grayscale value of at least one adjacent pixel to be equal to or less than a predetermined threshold value.

Here, the processor 140 may set the color coordinates of the pixels in order for the difference between the Lab color coordinate value corresponding to the maximum grayscale value of the pixel and the Lap color coordinate value corresponding to the maximum grayscale value of least one adjacent pixel to be equal to or less than a preset threshold value.

In other words, the processor 140 may set the target color gamut for each of the pixel, the first adjacent pixel and the second adjacent pixel by adjusting the color coordinates of the pixel, the first adjacent pixel and the second adjacent pixel in order for the color gamut difference value between the pixel and at least one first adjacent pixel and the first adjacent pixel and at least one second adjacent pixel which is adjacent to the first adjacent pixel to be respectively equal to or less than a predetermined threshold value.

In this case, the processor 140 may adjust at least one of the color coordinates corresponding to the maximum grayscale value of each of the sub pixels of each pixel, the first adjacent pixel and the second adjacent pixel, and set the color gamut defined by the color coordinate corresponding to such an adjusted maximum grayscale value as the target gamut of each of the pixel, the first adjacent pixel, and the second adjacent pixel. However, in some cases, if the color gamut difference between the pixel, the first adjacent pixel, and the second adjacent pixel becomes equal to or less than a predetermined threshold value as a result of adjusting the color coordinates of the first adjacent pixel and the second adjacent pixel, the color coordinate of the pixel may not be adjusted, and the intrinsic color gamut of the pixel may be set as the target gamut of the pixel.

In this case, since the color gamut of a pixel indicates the range of colors that can be represented by the pixel, the color gamut cannot be adjusted so that the pixel is wider than the original color gamut of the pixel. Accordingly, the processor 140 may determine the target color gamut of each pixel while reducing the color gamut of the pixel itself.

Meanwhile, in adjusting the color gamut, there may be a case of adjusting the color gamut of all pixels and a case of adjusting the color gamut of only some pixels.

In the case where the processor 140 adjusts the color gamut of all pixels, the adjusted color gamut may be determined as the target color gamut of each pixel. Meanwhile, in the case where the processor 140 adjusts the color gamut of only some pixels, the adjusted color gamut may be determined as the target color gamut of the pixel in which the color gamut is adjusted, and the original color gamut may be determined as the target color gamut of the pixel in which the color gamut is not adjusted.

In the above example embodiments, the color coordinates corresponding to the maximum grayscale value of the pixel and the adjacent pixel are adjusted in order for the color gamut difference between the pixel and the adjacent pixel to be equal to or less than a predetermined threshold value, and the color gamut defined by the adjusted color coordinate is set as the target color gamut. However, this is only an example, and according to the method of determining the color gamut difference, the color coordinates corresponding to at least one grayscale value of a pixel and adjacent pixels may be adjusted or the color coordinates of a portion not common to the color gamut may be adjusted, and the color gamut defined by the adjusted color coordinates can be set as the target color gamut.

Meanwhile, in addition to the above-mentioned method, the processor 140 may set the target color gamut for the pixel by performing a smoothing process with respect to the color gamut of the pixel.

Meanwhile, the method of determining the color gamut difference and the method of setting the target color gamut have been described in detail with reference to FIG. 2.

The processor 140 may drive the panel driver 120 in order for each of the plurality of pixels to have a grayscale value based on the target color gamut.

Specifically, once the target color gamut is determined, the processor 140 may determine a correction coefficient for correcting the color gamut of the pixel to a target color gamut.

Here, the correction coefficient may be a gain value for a current value (or a voltage value) input to an LED element to correct a color gamut originally possessed by the pixel to a target gamut, or a duty ratio applied to a gain value.

In addition, the processor 140 may adjust a duty ratio of a driving signal (for example, R_Pulse, G_Pulse, B_Pulse) for driving each pixel based on a correction value and output the duty ratio to the panel driver 120. In this case, the panel driver 120 may provide a current to the display panel 110 according to the driving signal input from the processor 140 to drive each pixel.

Accordingly, each pixel may output data having the color of the target color gamut.

Meanwhile, in the above example, the target color gamut is determined and accordingly, the color gamut of each pixel is set as the target color gamut. However, information regarding the calculated target color gamut for each pixel may be stored in the display apparatus 100 in advance, and the display apparatus 100 may set the color gamut of each pixel as the target color gamut using the information stored in advance without calculating the target color gamut separately.

A non-transitory computer readable medium which stores a program for performing a calibration method according to an example embodiment, may be provided.

The non-transitory computer readable medium is readable by an apparatus. Specifically, the above-described various applications or programs may be stored and provided in a non-transitory computer readable medium such as a CD, a DVD, a hard disk, a Blu-ray disk, a universal serial bus (USB), a memory card, a ROM, or the like, but is not limited thereto.

Although a bus is not shown in the above-described block diagram of the display apparatus, communication between the respective components in the display apparatus may be performed through a bus. In addition, each device may further include a processor such as, for example, and without limitation, a CPU, a microprocessor, a dedicated processor, or the like that performs the above-described various steps.

The foregoing example embodiments and advantages are merely examples and are not to be construed as limiting the example embodiments. The present teaching can be readily applied to other types of apparatuses. Also, the description of the example embodiments of the present disclosure is intended to be illustrative, and not to limit the scope of the claims.

What is claimed is:

1. A display apparatus, comprising: a display panel comprising a plurality of pixels; a panel driver configured to drive the display panel; a storage configured to store information of a color gamut of each of the plurality of pixels; and a processor configured to determine a target color gamut of a pixel from among the plurality of pixels that enables a color gamut difference between a color gamut of the pixel and a color gamut of at least one pixel adjacent to the pixel to be equal to or less than a predetermined threshold value, and to drive the panel driver for the plurality of pixels to have a predetermined grayscale value, wherein the predetermined grayscale value is determined based on the target color gamut, and wherein the processor is configured to determine a color coordinate of the pixel that enables a color coordinate difference between a color coordinate corresponding to a maximum grayscale value of the pixel and a color coordinate corresponding to a maximum grayscale value of the at least one adjacent pixel to be equal to or less than the predetermined threshold value.

2. The apparatus as claimed in claim 1, wherein the predetermined threshold value is set based on a Just Noticeable Difference (JND) of the color gamut difference with respect to the at least one pixel.

3. The apparatus as claimed in claim 1, wherein the processor is configured to determine the target color gamut of the pixel color gamut difference between the color gamut of the pixel and the color gamut of a first pixel adjacent the pixel and a color gamut difference between the first pixel adjacent the pixel and a second pixel adjacent the first pixel to be equal to or less than the predetermined threshold value.

4. The apparatus as claimed in claim 1, wherein the processor is configured to determine the color coordinate of the pixels that enables the color coordinate difference to be equal to or less than the predetermined threshold value.

5. The apparatus as claimed in claim 4, wherein the processor is configured to determine the color coordinate of the pixels that enables a difference in Lab color coordinate between a maximum grayscale value of the pixel and a maximum grayscale value of the at least one pixel to be equal to or less than the predetermined threshold value.

6. A calibration method, comprising:

determining a color gamut difference between a pixel and at least one adjacent pixel based on information of a color gamut of a plurality of pixels; and determining a target color gamut of the pixel that enables the determined color gamut difference to be equal to or less than a predetermined threshold value, wherein the determining the target color gamut of the pixel comprising determining a color coordinate of the pixel that enables a color coordinate difference between a color coordinate corresponding to a maximum grayscale value of the pixel and a color coordinate corresponding to a maximum grayscale value of the at least one pixel to be equal to or less than the predetermined threshold value.

7. The method as claimed in claim 6, wherein the predetermined threshold value is determined based on a Just Noticeable Difference (JND) of the color gamut difference with respect to the at least one pixel.

8. The method as claimed in claim 6, wherein the determining comprises determining a target color gamut of the that enables the color gamut difference between the color gamut of the pixel and the color gamut of a first pixel adjacent the pixel and a color gamut difference between the first pixel adjacent the pixel and a second pixel adjacent the first pixel to be equal to or less than the predetermined threshold value.

9. The method as claimed in claim 6, wherein the determining comprises determining the color coordinate of the pixels that enables a difference in Lab color coordinate between a maximum grayscale value of the pixel and a maximum grayscale value of the at least one pixel to be equal to or less than the predetermined threshold value.

* * * * *